US010442657B1

(12) United States Patent
Hinnant

(10) Patent No.: US 10,442,657 B1
(45) Date of Patent: Oct. 15, 2019

(54) IMMEDIATE MANUAL LOCKING ARRANGEMENT FOR RETRACTABLE LANYARDS AND USES THEREFOR

(71) Applicant: Garrett Lee Hinnant, Dade City, FL (US)

(72) Inventor: Garrett Lee Hinnant, Dade City, FL (US)

( * ) Notice: Subject to any disclaimer, the term of this patent is extended or adjusted under 35 U.S.C. 154(b) by 196 days.

(21) Appl. No.: 15/655,123

(22) Filed: Jul. 20, 2017

Related U.S. Application Data

(60) Provisional application No. 62/369,374, filed on Aug. 1, 2016.

(51) Int. Cl.
*B65H 75/44* (2006.01)
*B65H 75/48* (2006.01)

(52) U.S. Cl.
CPC ..... *B65H 75/4442* (2013.01); *B65H 75/4402* (2013.01); *B65H 75/486* (2013.01)

(58) Field of Classification Search
CPC ..... B65H 75/4434; B65H 75/4442; B65H 75/486; B65H 75/4402; A01K 27/004
See application file for complete search history.

(56) References Cited

U.S. PATENT DOCUMENTS 529,402 A 11/1894 McDougall
721,460 A 2/1903 McDougall
1,120,341 A 12/1914 Smith
6,039,708 A 3/2000 Schaming
6,125,966 A 10/2000 Jones
7,364,109 B2 4/2008 Kuo
7,523,883 B2 * 4/2009 Cheng ..... B65H 75/4434 242/378
7,618,385 B2 11/2009 Poole
7,784,727 B1 * 8/2010 Liao ..... B65H 75/4431 242/378.1
7,892,193 B2 2/2011 Marchetto
8,136,751 B2 * 3/2012 Chen ..... B65H 75/4434 242/378.1
8,584,799 B1 11/2013 Dennington
8,702,025 B2 * 4/2014 Kish ..... B65H 75/4434 242/378.1
8,757,532 B2 6/2014 Votel et al.
2006/0261203 A1 * 11/2006 Yang ..... B65H 75/4431 242/378.4

(Continued)

FOREIGN PATENT DOCUMENTS

EP 1 776 987 4/2007
EP 2 119 478 11/2009

*Primary Examiner* — William A. Rivera
(74) *Attorney, Agent, or Firm* — Wendy W. Koba

(57) ABSTRACT

A manual mechanism for immediately locking a retractable lanyard is proposed where the locking mechanism is easily manipulated by the user and locks the assembly immediately with a precise, desired amount of cable exposed. The mechanism takes the form of a set of spring-loaded locking pins that engage the tracks on the top of the cable spool. A lever controls the spring and moves the pins between engaging with the spool (the "locked" position) when the spring is compressed, and "unlocked" when the spring is relaxed and the locking pins are retracted. This mechanism can be added to or manufactured within a lanyard to override the existing latching mechanism.

7 Claims, 12 Drawing Sheets

(56) References Cited

U.S. PATENT DOCUMENTS

| | | | | |
|---|---|---|---|---|
| 2007/0001046 | A1* | 1/2007 | Wu | B65H 75/4434<br>242/378.1 |
| 2007/0181730 | A1* | 8/2007 | Yen | B65H 75/4434<br>242/378.1 |
| 2009/0206189 | A1* | 8/2009 | Liao | B65H 75/4434<br>242/379.2 |
| 2012/0153064 | A1* | 6/2012 | Votel | B65H 75/48<br>242/378.4 |

* cited by examiner

IMMEDIATE MANUAL LOCKING ARRANGEMENT FOR RETRACTABLE LANYARDS AND USES THEREFOR

CROSS-REFERENCE TO RELATED APPLICATIONS

This application claims the benefit of U.S. Provisional Application Ser. No. 62/369,374, filed Aug. 1, 2016, and herein incorporated by reference.

TECHNICAL FIELD

The present invention relates to a retractable lanyard and, more particularly, to a locking arrangement for providing immediate, manual locking of the lanyard at any desired location.

BACKGROUND OF THE INVENTION

Retractable lanyards are known in the art and are configured to attach to a person or object, allowing for a range of motion, but preventing a free-fall accident by preventing the complete pay-out of the line. In many designs, a multi-piece reader arm and spool are configured to prevent the pay-out, where the spool is formed to include a number of tracks and as the spool rotates, the reader arm will gradually engage with one of the tracks to prevent further rotation of the spool.

While useful in the prevention of pay-out, this type of retractable lanyard cannot be "immediately locked" at any desired location. The configuration of the tracks in the spool dictates the discrete locations where the reader arm will engage with the spool and prevent further rotation. As with any type of retractable line (for example, a seat belt, cable or the like), when an individual desires to "lock" a retractable lanyard in a position, the individual must quickly pull out the line until the reader arm engages with a track. As a result, there is no way to know beforehand how much of the line will become exposed before the locking mechanism engages. In some cases, too much line becomes exposed before locking occurs and may result in an unsafe condition or an undesired position.

Simply stated, a user of a retractable lanyard cannot gauge exactly how much line will be let out before locking occurs.

SUMMARY OF THE INVENTION

The needs remaining in the prior art are addressed by the present invention, which relates to a manual mechanism for immediately locking a retractable lanyard and, more particularly, to a locking mechanism that is easily manipulated by the user and locks the assembly immediately with a precise, desired amount of cable exposed. The mechanism is easily "locked" and "unlocked" by the movement of a lever, and can be added to or manufactured within a lanyard to override the existing latching mechanism.

Advantageously, the inventive manual locking lanyard is particularly well-suited for a variety of industrial applications, where the pay-out of a lanyard needs to be precision-controlled and reliable. An inventive type of harness support useful for workers that need to spend extended periods of time leaning back (while extending their arms to perform manual tasks), benefits greatly from the inventive manual locking arrangement, as will also be discussed below.

One exemplary embodiment of the present invention takes the form of manual locking arrangement for a lanyard, the locking arrangement comprising a spool for storing a lanyard cable in a coiled configuration (the spool including an outer cover with a plurality of tracks for controlling pay-out of the lanyard cable), and a plurality of spring-loaded, retractable locking studs disposed orthogonal to the plurality of tracks, the plurality of locking studs engaging with the plurality of tracks when an included spring is manually controlled to be in its compressed state, thereby preventing rotation of the spool and locking the pay-out of the lanyard cable.

Other and further embodiments and aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
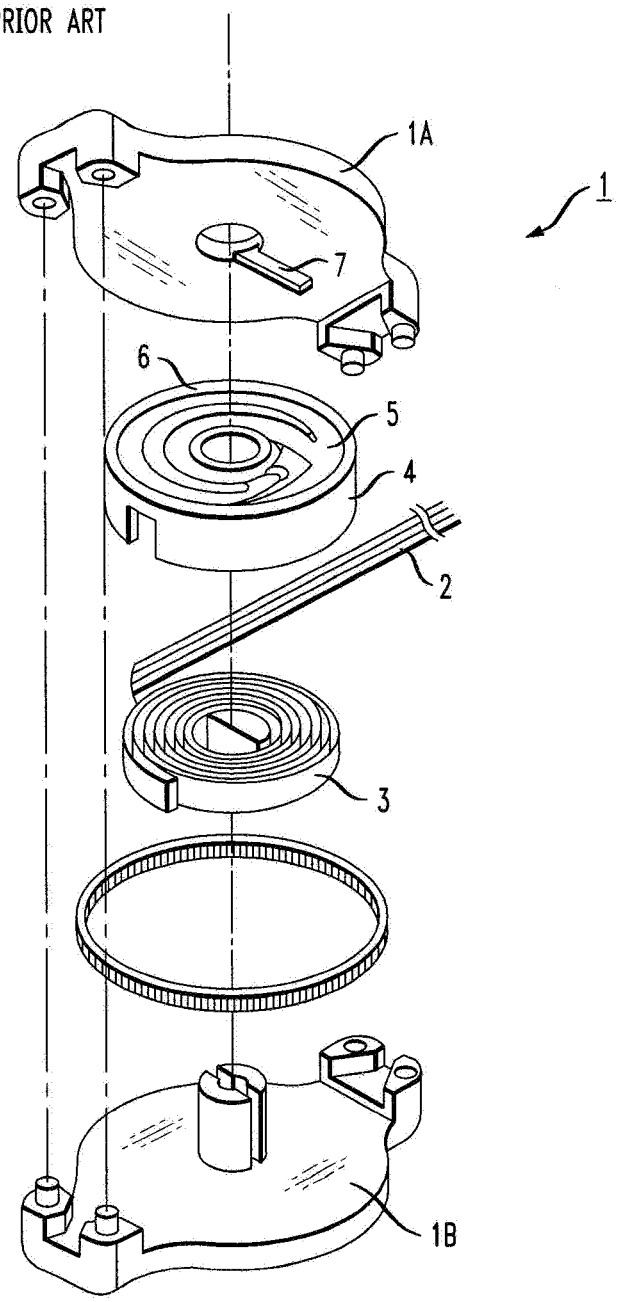
FIG. 1 PRIOR ART
FIG. 1 illustrates a conventional prior art retractable lanyard.

FIG. 1 illustrates relevant components of a prior art retractable lanyard that are useful to understand so as to fully appreciate the improvement provided by the present invention. Shown in FIG. 1, in exploded view, is a typical housing 1 (including a top housing plate 1A and a lower housing plate 1B) for enclosing a retraction mechanism that controls the movement of a line (or cable) 2. The retraction mechanism allows for a portion of line 2 to be pulled out of housing 1 and then held fixed in place. The same mechanism is activated to disengage the locking arrangement such that the payed-out portion of line 2 is retracted to be stored within the housing. A heavy-duty spring 3 is used to provide the necessary tension on line 2, and line 2 is wound within a spool 4. As shown, spool 4 contains a number of separate sections 5 (referred to as "tracks") formed in its top surface 6. A reader arm 7, or similar element, engages with tracks 5 in a known manner to control the pay-out of line 2. While the term "line" may be used at times throughout this discussion, it is to be understood that a retractable lanyard may be formed to control the movement of a cable.

As mentioned above, a problem remaining with this configuration is that the design of the tracks controls the length of the portion of cable that is exposed in any locked position. In accordance with the present invention, as shown in following FIGS. 2-7, a more precise manual locking arrangement may be added to this configuration such that the user of the lanyard can immediately lock the device in any desired configuration, with any precise amount of cable being exposed.

As will be described below, the manual locking arrangement of the present invention provides this feature by including a set of retractable locking studs disposed orthogonal to the tracks. When the locking studs are released, they immediately engage with the spool (via the tracks) and prevent any further rotation of the spool, regardless of the position of the reader arm with respect to the tracks.

Figure 2:
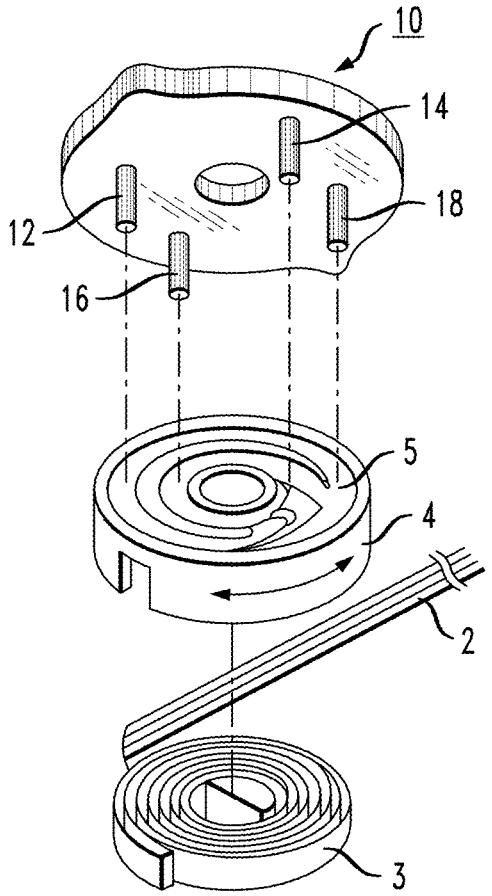
FIG. 2 illustrates an exemplary immediate manual locking arrangement formed in accordance with the present invention.

FIG. 2, in simplified form, explains the mechanical action of the present invention. As shown, a manual locking arrangement 10 formed in accordance with the present invention includes a plurality of retractable studs 12, 14, 16, and 18. The studs are spring-loaded, as will be described in detail below, such that a user is able to control them. In the "retracted" position (i.e., when the spring is de-compressed), the studs will be contained within housing 10. When the user moves a lever, the spring will compress and the studs will immediately emerge from housing 10 in the manner shown in FIG. 2. Manual locking arrangement 10 is positioned over (and aligned with) a conventional retractable lanyard in the manner shown in FIG. 2 such that studs 12, 14, 16 and 18 (when exposed) quickly engage with tracks 5 and prevent movement of spool 4. Since spool 4 cannot rotate, cable 2 cannot be further pulled out. Thus, the user has exposed only the length of cable 2 that is desired.

Figure 3:
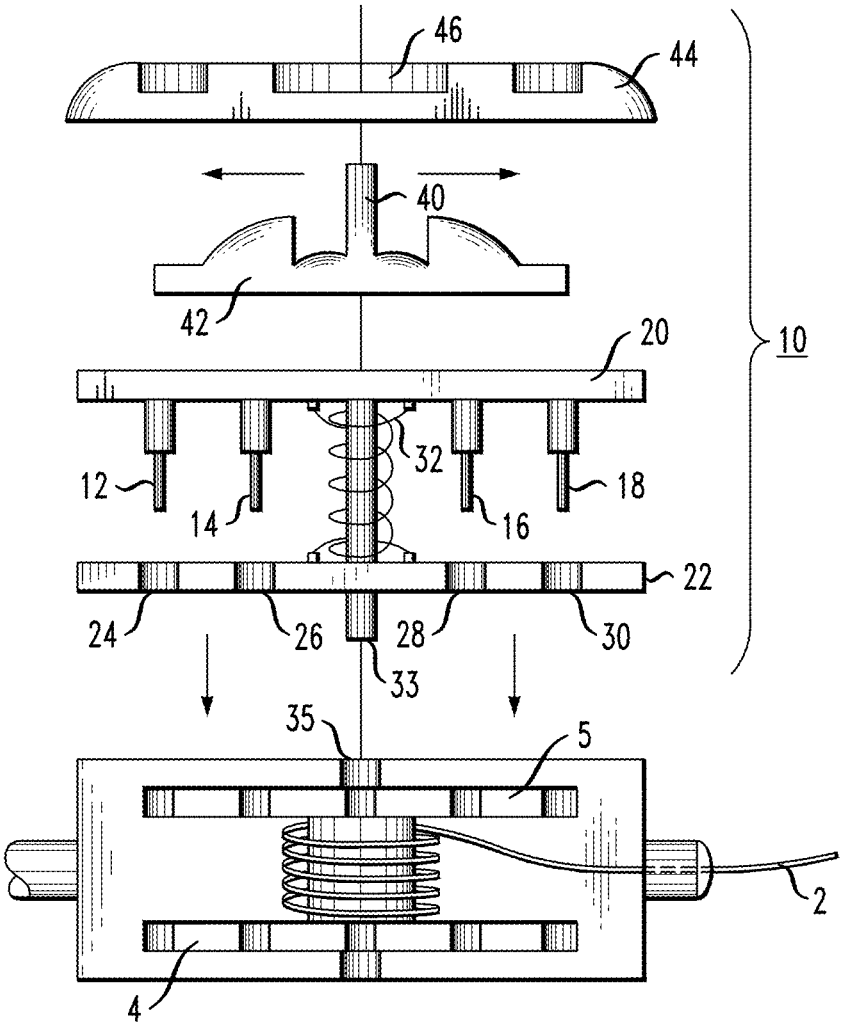
FIG. 3 is an exploded view of the details of the immediate manual locking arrangement of the present invention, also illustrating a portion of a retractable lanyard.

FIG. 3 is an exploded view of the details of manual locking arrangement 10, with a portion of a conventional retractable lanyard also shown. In this view, the plurality of retractable studs 12, 14, 16 and 18 is shown as attached to a gear plate 20. Manual locking arrangement 10 also includes an apertured plate 22 containing a plurality of apertures 24, 26, 28 and 30. In accordance with the present invention, aperture plate 22 is positioned in alignment with gear plate 20 in the manner shown in FIG. 3, such that when activated the studs will pass through apertures 24, 26, 28 and 30. After passing through these apertures, retractable studs 12, 14, 16, and 18 will then quickly engage with tracks 5 of spool 4, and "lock" spool 4 in place, thus preventing any additional cable 2 from unreeling.

As mentioned above and shown in FIG. 3, the action of retractable studs 12, 14, 16 and 18 is spring loaded, utilizing a spring 32 disposed between gear plate 20 and apertured plate 22. When there is no tension applied to spring 32, the studs are in their retracted position (i.e., remain on top of apertured plate 22) and the lanyard's spool, tracks and reader arm function in a conventional fashion, resorting to the lanyard having centrifugal force action for locking.

Once spring 32 is forced into contraction (by the action of the user), gear plate 20 and apertured plate 22 move toward each other such that studs 12, 14, 16 and 18 are exposed through apertures 24, 26, 28 and 30. The exposed studs thereafter engage with tracks 5 and spool 4 in the manner described above to prevent spool 4 from rotating.

Therefore, by virtue of the spring tension, studs 12, 14, 16 and 18 remain fixedly in place within the spool—providing a "locked" arrangement. No further motion of the spool is possible until the user returns the configuration to the position where spring 32 is released. When spring 32 is released, gear plate 20 and aperture plate 22 will move away from each other, and studs 12, 14, 16 and 18 will retract into the housing.

In the embodiment shown in FIG. 3, a lever 40 is included in the arrangement and is used by an individual to control the compression/release of spring 32 and the movement of studs 12, 14, 16 and 18. Lever 40 is shown as part of an intermediate component 42, with an outer housing 44 disposed over intermediate component 42. Outer housing 44 contains an aperture 46 such that lever 40 is exposed through outer housing 44. Movement of lever 40 in the directions shown by the arrows in FIG. 3 is seen to control the action of spring 32 and provide the desired, immediate manual "locking" and "unlocking" functions.

Figure 4:
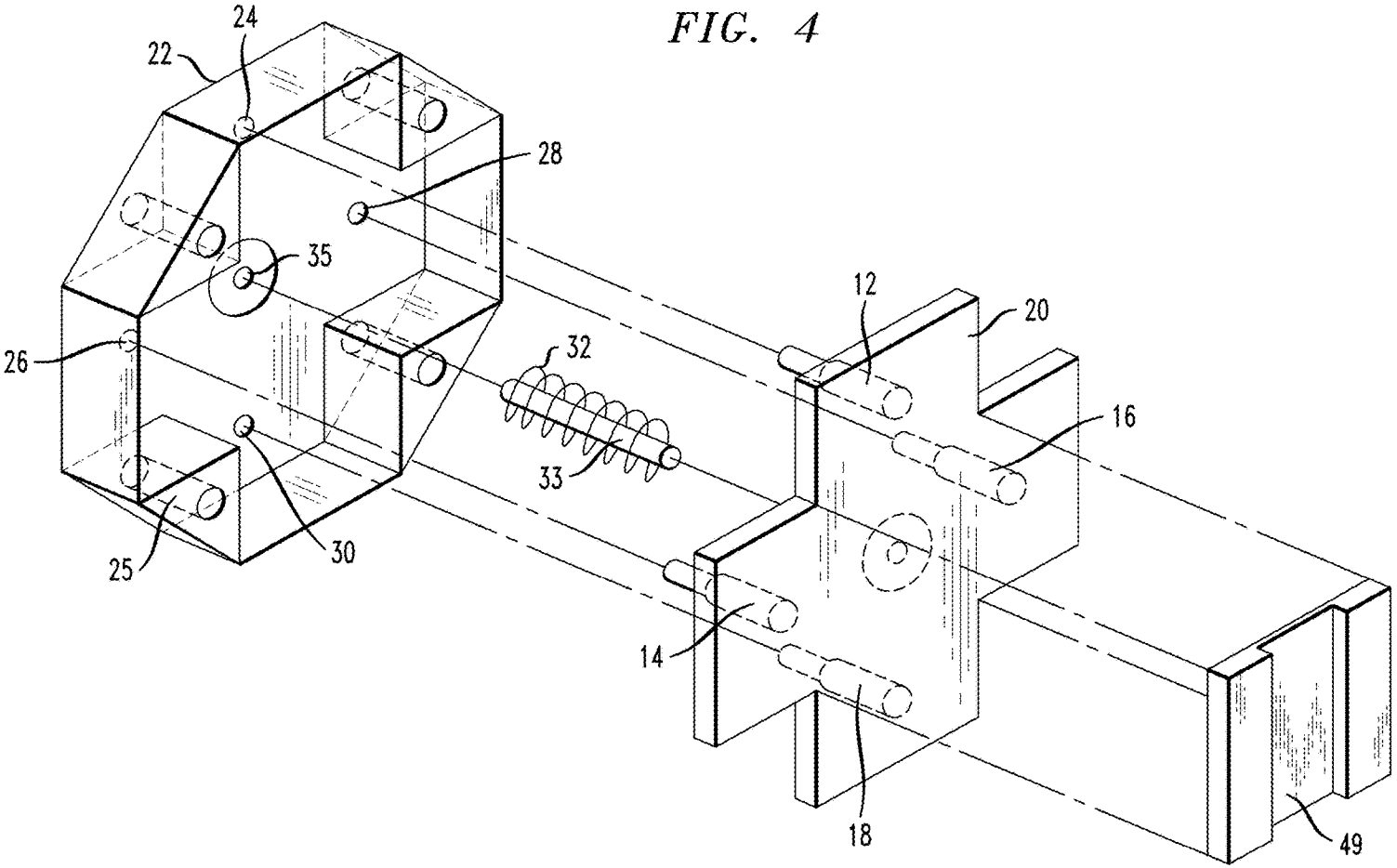
FIG. 4 is an exploded view of a subset of components utilized in configured the immediate manual locking arrangement of the present invention.

FIG. 4 is another exploded view of several components of the present invention. Shown in this view is a guide piece 49 which may be attached (e.g., glued) to gear plate 20 and used to hold intermediate component 42 (not shown) in place. A guide pin 33 and spring 32 are clearly shown in this view, indicating their position between gear plate 20 and apertured plate 22. Apertures 24, 26, 28 and 30 are also shown in this view. Guide pin 33 is attached to a central portion of an underside of gear plate 20 and is able to extend downward through a pinhole 35 formed in apertured plate 22 when spring 32 is compressed. Lever 40 is used to move guide pin 33 between a position aligned with pinhole 35 so as to create compression of spring 32 and exposure of the plurality of locking pins 12, 14, 16, and 18 through apertures 24, 26, 28, and 30, and a position mis-aligned with pinhole 35 so as to create relaxation of spring 32 and retraction of the plurality of locking pins 12, 14, 16, and 18 into the space between gear plate 20 and apertured plate 22.

Figure 5:
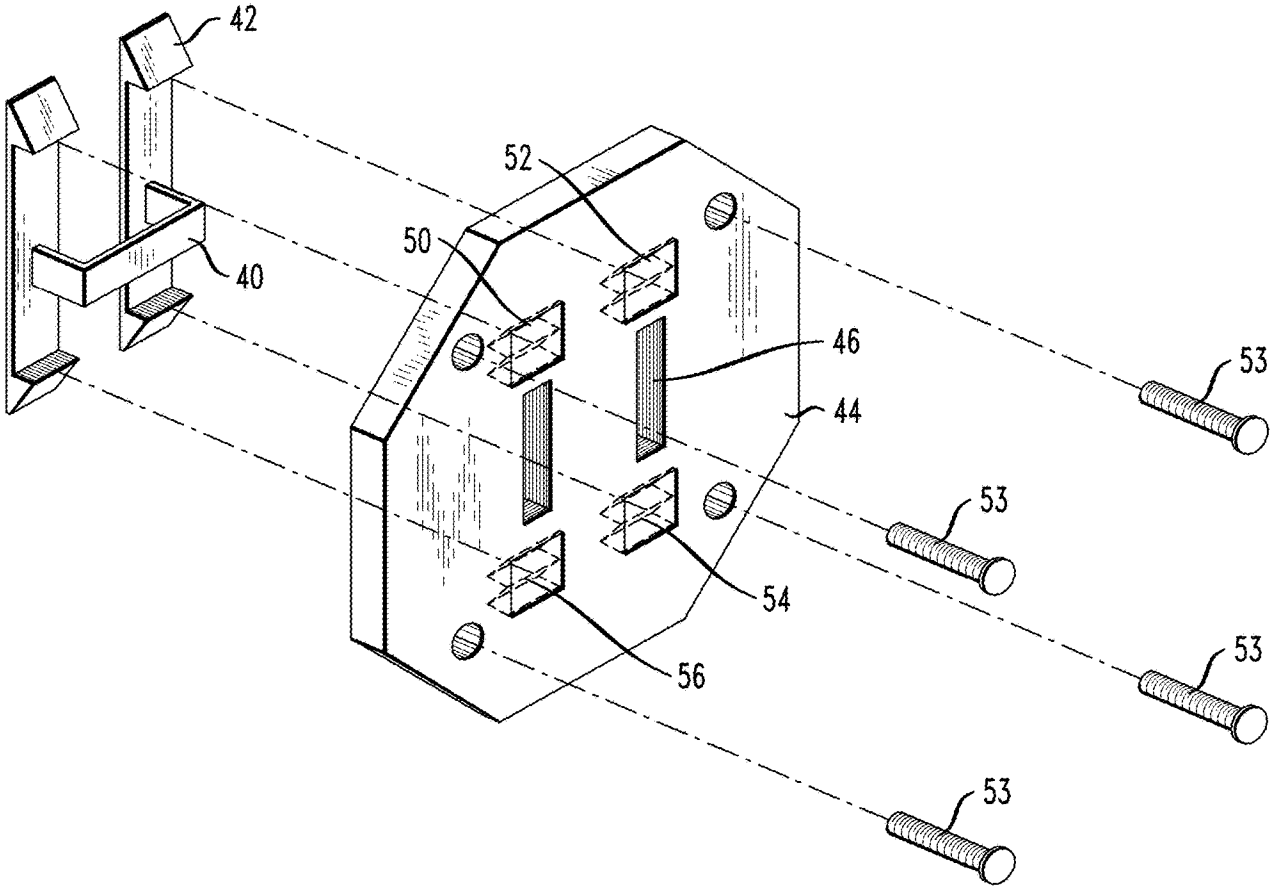
FIG. 5 is an exploded view of an outer portion of the immediate manual locking arrangement of the present invention.

FIG. 5 is an exploded view of the outer portion of manual locking arrangement 10, showing the working components associated with lever 40. Outer housing 44 is shown as including slots 46, as well as a plurality of wedge stops 50, 52, 54 and 56 that control the excursion of lever 40 along slots 46.

The components shown in FIGS. 4 and 5 are assembled (preferably from left to right, as shown in both drawings) to form the final structure of manual locking arrangement 10. A plurality of non-threaded screw housing tubes 25 is shown in FIG. 4 as formed on aperture plate 22. Housing tubes 25 pass through mounting holes formed in the assembled elements shown in FIGS. 4 and 5, and ultimately engage with a plurality of screws 53 as shown in FIG. 5 to hold everything together. It is to be noted that to the left of the components of FIG. 4, there will be the top outer case of the associated lanyard (not shown). Additionally, is it shown that in this particular configuration gear plate 20 (FIG. 4) has an outer shape similar to a "plus" sign and apertured plate 22 has an octagonal shape (when looking head-on), allowing for gear plate 20 to easily move between a contracted and expanded position with aperture plate 22, as controlled by the movement of spring 32.

Figure 6:
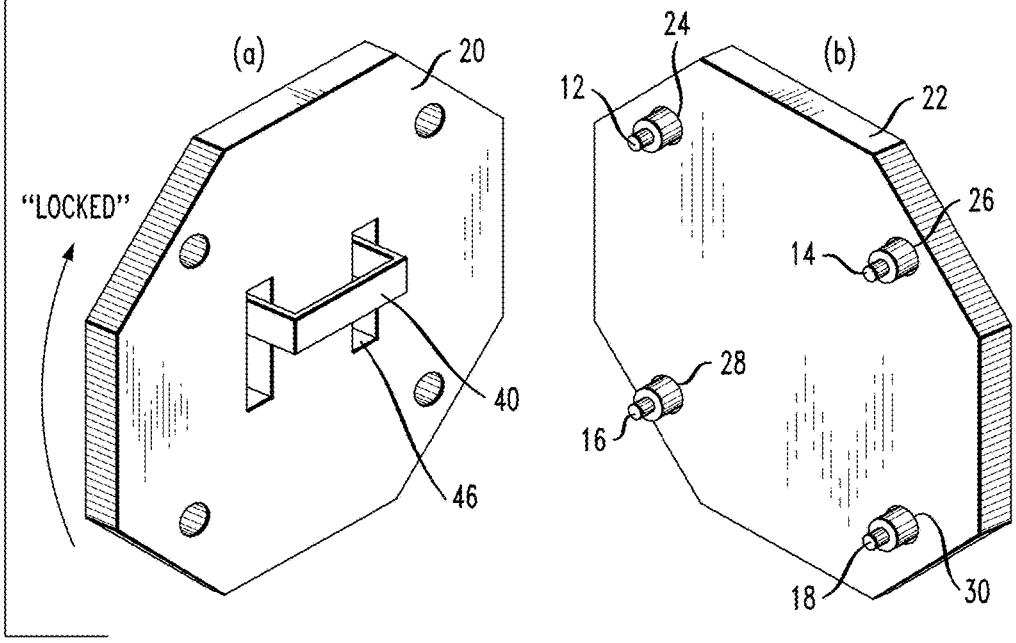
FIG. 6 illustrates the inventive immediate manual locking arrangement in its "locked" position, with FIG. 6(*a*) being a top view and FIG. 6(*b*) being a view of the underside.

FIG. 6 illustrates manual locking arrangement 10 in its "locked" position. FIG. 6(*a*) is a top view from gear plate 20, showing lever 40 being in the "locked" position along slots 46 (in this case, pushed upward as indicated by the arrows).

As discussed above, the "locked" position of arrangement 10 means that spring 32 (not shown) is fully compressed, such that locking studs 12, 14, 16 and 18 are fully exposed through apertured plate 22. Exposed locking studs immediately engage with the spool and lock the configuration in place. FIG. 6(*b*) is an underside view of the "locked" position of arrangement 10 from aperture plate, showing all four studs 12, 14, 16 and 18 as being exposed through their respective apertures.

Figure 7:
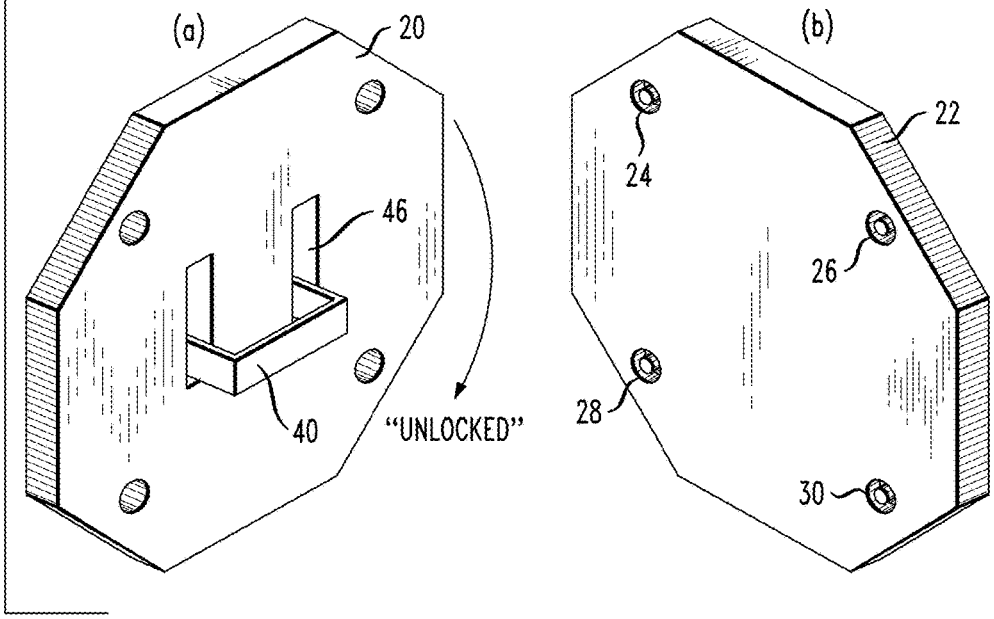
FIG. 7 illustrates the inventive immediate manual locking arrangement in its "unlocked" position, with FIG. 7(*a*) being a top view and FIG. 7(*b*) being a view of the underside.

FIG. 7 illustrates manual locking arrangement 10 in its "unlocked" (i.e., retracted) position. FIG. 7(*a*) is a top view that shows lever 40 fully downward along slots 46 (shown by the arrow in FIG. 7(*a*) as well). FIG. 7(*b*) is a view from apertured plate 22, illustrating how all four locking studs are fully retracted into arrangement 10; that is, the studs do not protrude beyond apertured plate 22. Internal spring 32 (not shown) is thus fully expanded so that gear plate 20 is moved away from aperture plate 22 and the studs are retracted to remain within the housing. When in this position, the retractable lanyard will function in its conventional manner, resorting to the lanyard's normal centrifugal force action for locking.

Therefore, by the simple and quick movement of lever 40, a user is able to "override" the normal centrifugal action of a retractable lanyard and is able to lock the cable at any desired, precise length, unlocking just as easily by moving lever 40 into its home position.

As mentioned above, one of the possibly many different applications for the manual locking arrangement of the present invention is as part of a support system for a back harness. In many different industries, a variety of tasks need to be performed while the individual is either crouched down or leaning back at an angle (with arms extended somewhat overhead in performing assigned jobs). For example, welders often have a difficult time welding together the undersides of adjacent pipes (i.e., the weld from 3 o'clock to 6 o'clock and the weld from 6 o'clock to 9 o'clock). The welder has no support for his head, neck or back and after extended periods of time may find their arms shaking from muscle fatigue. The shaking often compromises the quality and integrity of the welds, making it more costly for the employer to correct the errors.

A solution to this problem is proposed in accordance with the present invention by the utilization of a back harness that incorporates a pair of the inventive manual locking lanyards for support.

Figure 8:
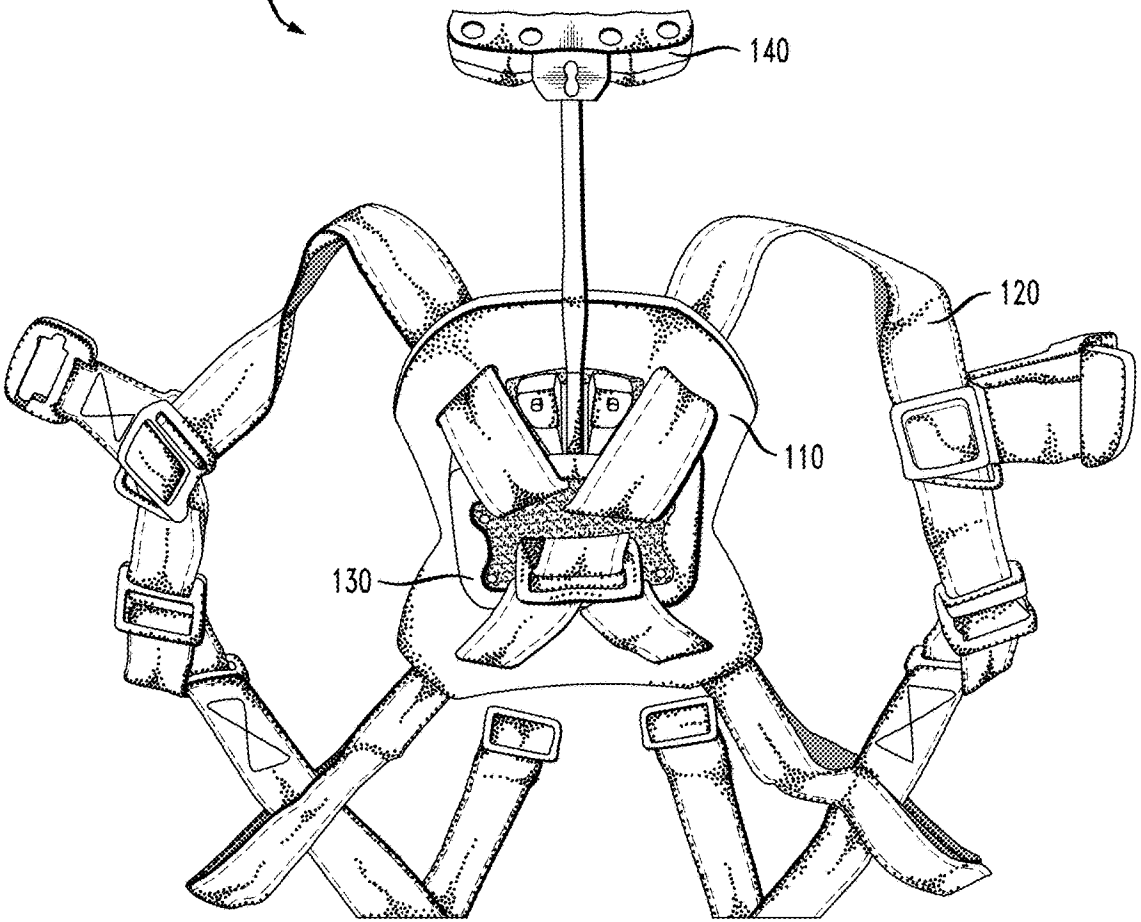
FIG. 8 depicts an exemplary back harness that may be used in conjunction with a pair of lanyards with immediate manual locking arrangements formed in accordance with the present invention.
Figure 9:
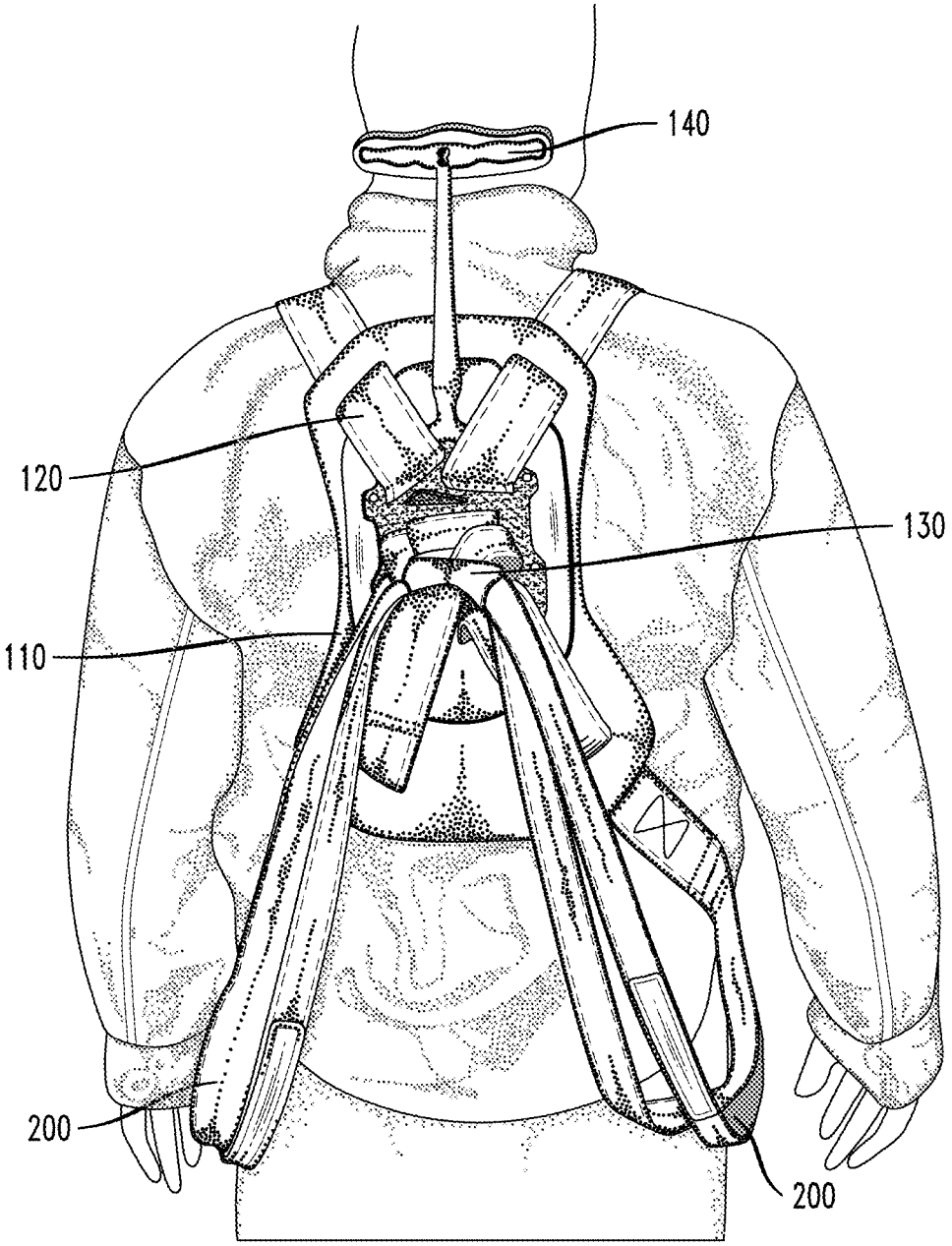
FIG. 9 is a rear view of the harness of FIG. 8.

FIG. 8 depicts an exemplary back harness 100 that may be used in conjunction with a pair of lanyards, with immediate manual locking arrangements formed in accordance with the present invention. Back harness 100 is shown as including a padded component 110 which rests against an individual's back when in use, with a plurality of straps 120 crossing across a midpoint 130 of padded component 110, and then locking in place across the individual's chest in a known manner. Also shown in harness 100 is a neck and head support unit 140 (preferably, adjustable) that is used to relieve the tension that builds up along the base of the head, neck and spine during hours of manual labor when spent in many awkward and strenuous positions. FIG. 9 is another rear view of back harness 100, as being worn by an individual. The additional strapping 200 associated with the addition of the manual locking lanyards to harness 100 is also shown in this view.

Figure 10:
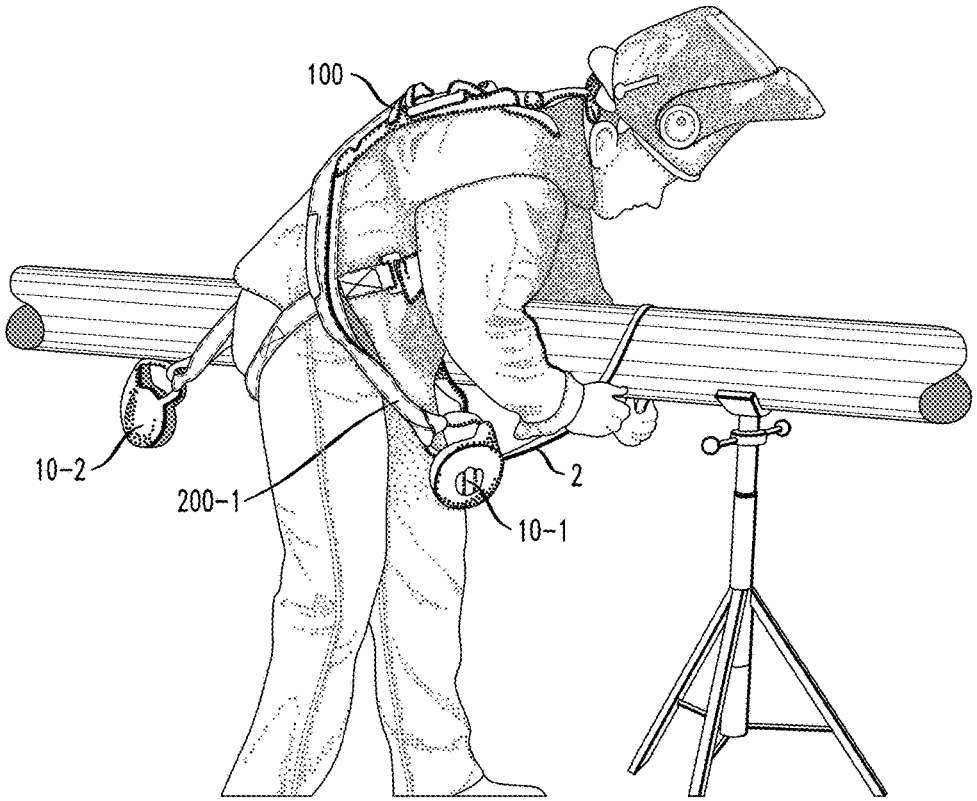
FIG. 10 illustrates the use of the harness of FIG. 8 in a pipe welding operation.
Figure 11:
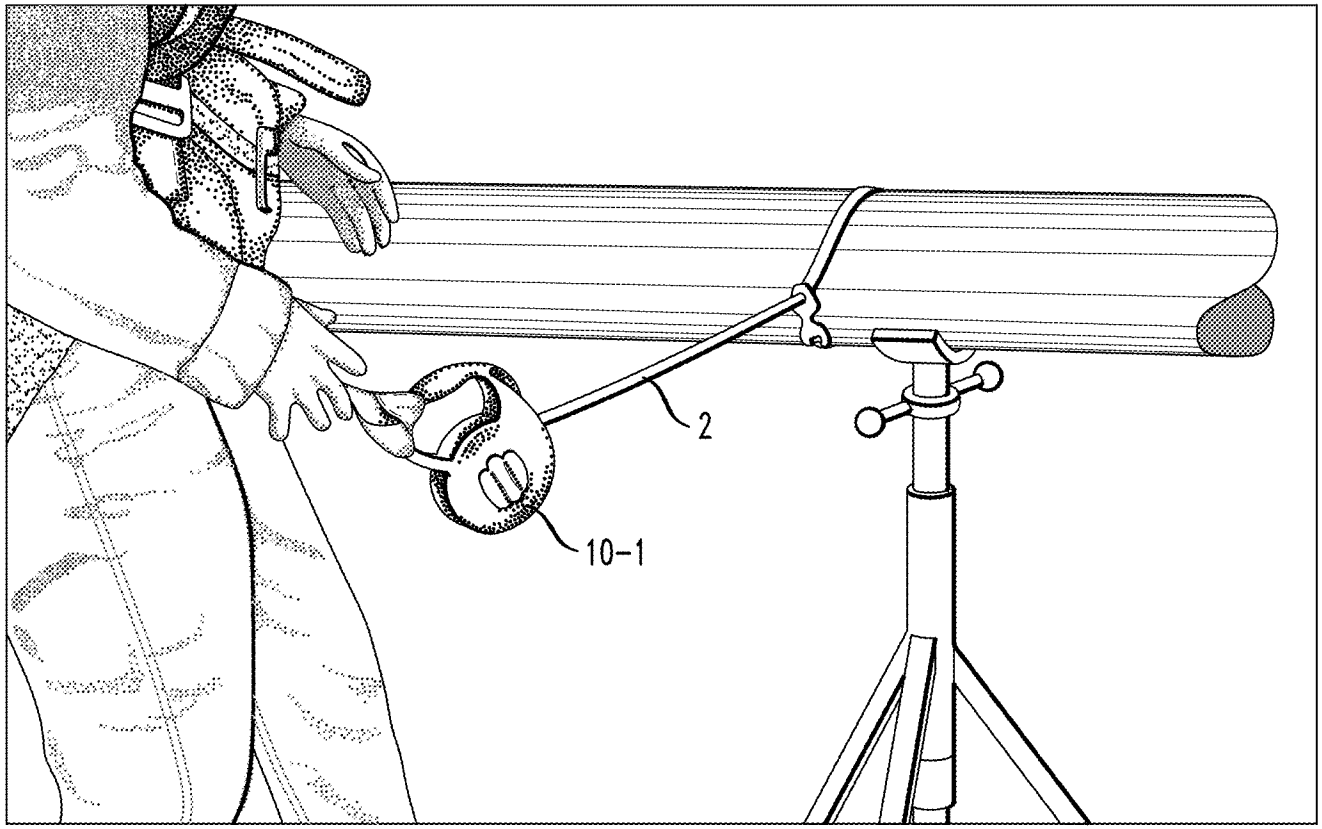
FIG. 11 is a close-up of the cable as it encircles the pipe.

FIG. 10 illustrates the use of the inventive back harness 100 in a pipe welding operation (the first step only being shown in FIG. 10). As shown, first manual locking lanyard 10-1 is attached to harness 100 via a first length of strapping 200-1. Here, a portion of line 2 is being payed out from first manual locking lanyard 10, with the user circling line 2 around a pipe that is to be welded. FIG. 11 is a close-up view of cable 2 as it encircles the pipe. The user can then allow a precise, predetermined length of cable 2 to pay out, and then quickly lock lanyard 10-1 in place at that exact location.

Figure 12:
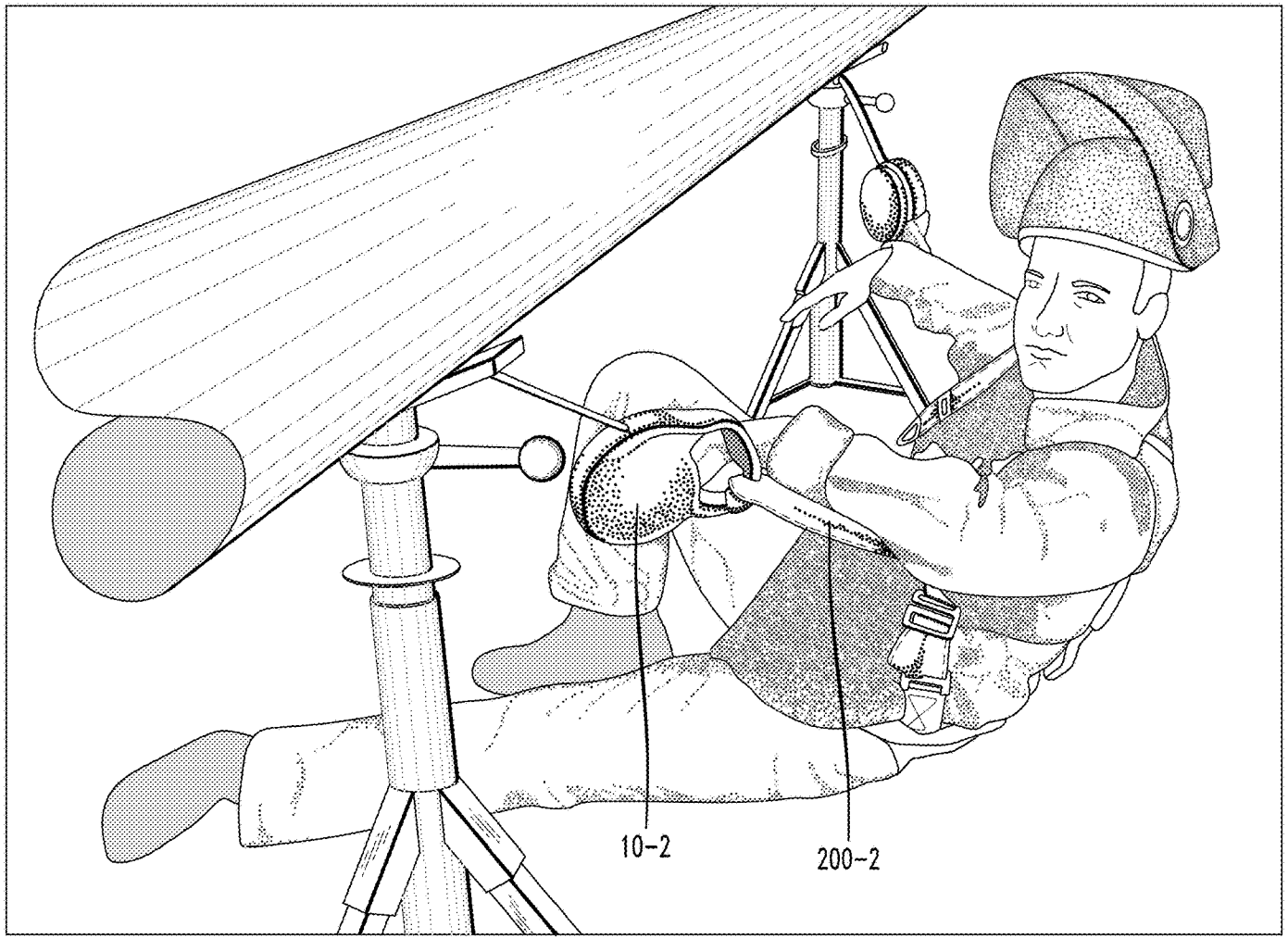
FIG. 12 illustrates the attachment of the second lanyard with the inventive immediate manual locking arrangement onto the pipe shown in FIG. 11.
Figure 13:
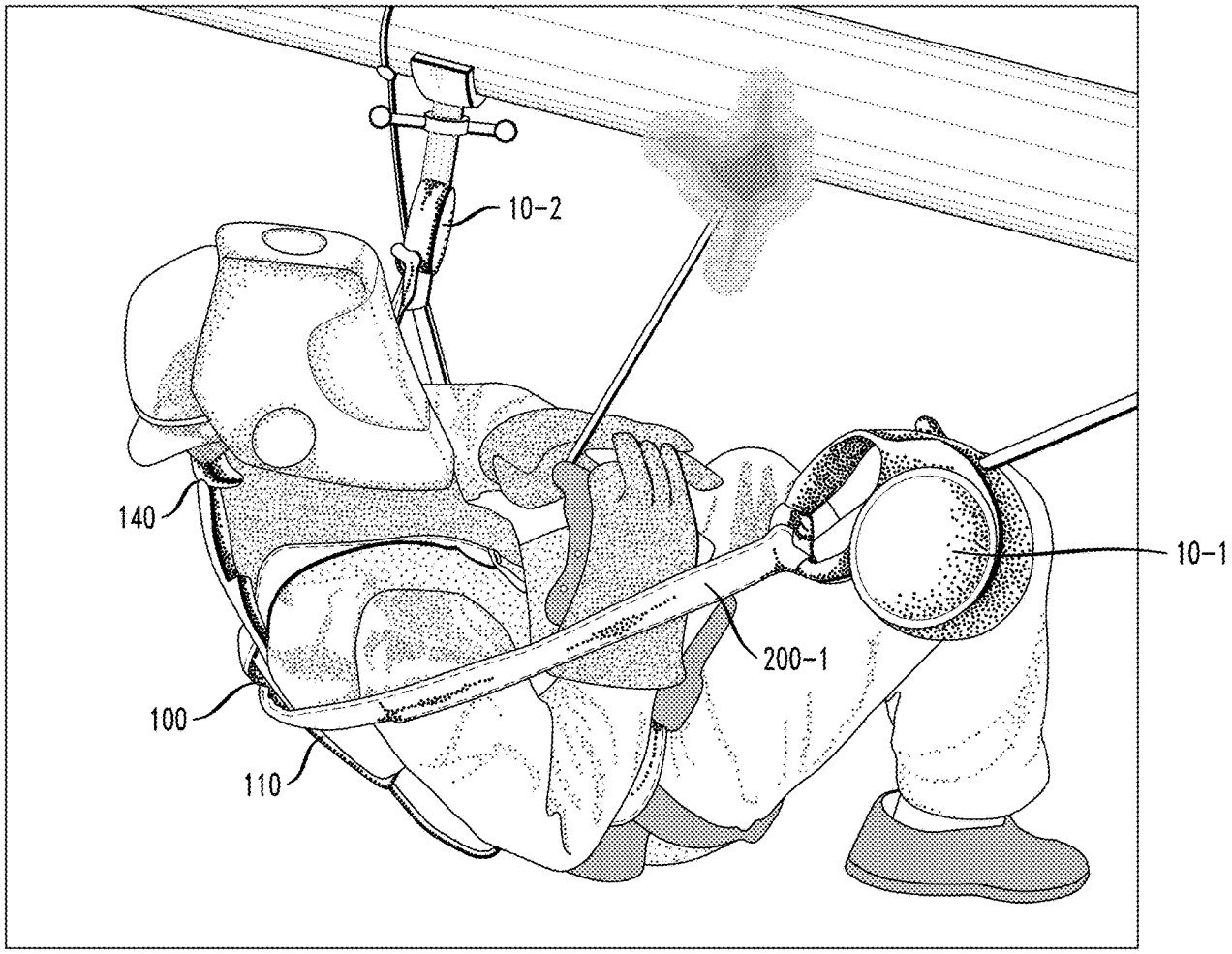
FIG. 13 illustrates the user in the process of precision welding, utilizing a pair of lanyards with immediate manual locking arrangements formed in accordance with the present invention.

The same steps are repeated with a second manual locking lanyard 10-2 attached to a second length of strapped 200-2, with the result shown in FIG. 12. Thus, with back harness 100 fully secured by the provision of a pair of manual locking lanyards 10-1 and 10-2, the individual is able to work on a section of pipe without experiencing any continuous back, head or neck strain. FIG. 13 illustrates the user in the process of precision welding, utilizing the support of padding 110 of harness 100. With the harness fully secured in place by manual locking lanyards 10-1 and 10-2, the welder continues to performing precision welding, shown as from positions 3 and 9 from position 6. It is to be noted that the manual locking lanyard of the present invention can be quickly repositioned by a simple flip of the lever during the precision welding process, allowing for the lanyards to be used with different sized pipes and/or different tasks.

While there has been shown and described what are considered to be preferred embodiments of the invention, it will of course be understood that various modifications and changes in form or detail may readily be made without departing from the spirit of the invention. It is therefore intended that the invention be not limited to the exact form and detail herein shown and described, nor to anything less than the whole of the invention as hereinafter claimed.

What is claimed is:

1. A manual locking arrangement for a lanyard, the locking arrangement comprising a spool for storing a lanyard cable in a coiled configuration, the spool including an outer cover with a plurality of tracks for controlling pay-out of the lanyard cable; and a housing for supporting a plurality of spring-loaded, retractable locking studs in an orientation orthogonal to the plurality of tracks, the plurality of locking studs engaging with the plurality of tracks when an included spring is in its compressed state, thereby preventing rotation of the spool and locking the pay-out of the lanyard cable, the plurality of locking studs retracted into the housing and separated from the plurality of tracks when the included spring is in its decompressed state.

2. The manual locking arrangement as defined in claim 1 wherein the arrangement further comprises a gear plate disposed within the housing and attached to the plurality of locking studs such that the plurality of locking studs are disposed orthogonal to a major surface of the gear plate; and an apertured plate disposed adjacent to the gear plate, the apertures plate comprising a plurality of apertures disposed to align with the plurality of locking studs, the apertured plate positioned next to the spool cover such that the plurality of locking studs pass through the apertured plate prior to engaging with the plurality of tracks; and a manually-controlled spring disposed between the gear plate and the apertured plate and used to control the movement of the plurality of locking studs such that when the spring is compressed the plurality of locking pins extend through the plurality of apertures formed in the apertured plate and when the spring is relaxed the plurality of locking pins is retracted and is positioned in a space in the housing between the gear plate and the apertured plate.

3. The manual locking arrangement as defined in claim 2 wherein the arrangement further comprises a lever control disposed beyond the gear plate and configured to engage with the manually-controlled spring, the lever controlling the movement of the manually-controlled spring between its compressed and relaxed states.

4. The manual locking arrangement as defined in claim 3 wherein the lever control comprises a guide pin attached to a central portion of an underside of the gear plate and extending downward through a pinhole formed in the apertured plate, where the manually-controlled spring is disposed to surround the guide pin; and a lever attached to an opposing major surface of the gear plate and used to move the guide pin between a position aligned with the pinhole so as to create compression of the spring and exposure of the plurality of locking pins through the apertured plate, and a position where the guide pin is mis-aligned with the pinhole so as to create relaxation of the spring and retraction of the plurality of locking pins into the space between the gear plate and the apertured plate.

5. The manual locking arrangement as defined in claim 1 wherein the plurality of locking pins comprises at least three locking pins.

6. The manual locking arrangement as defined in claim 5 wherein the plurality of locking pins comprises a set of four separate locking pins.

7. A back harness support system including a pair of retractable lanyards, a first retractable lanyard attached to a first side of the support system and a second retractable lanyard attached to a second, opposing side of the support system, wherein each retractable lanyard includes a manual locking arrangement comprising a spool for storing a lanyard cable in a coiled configuration, the spool including an outer cover with a plurality of tracks for controlling pay-out of the lanyard cable; and a housing for supporting a plurality of spring-loaded, retractable locking studs in an orientation orthogonal to the plurality of tracks, the plurality of locking studs engaging with the plurality of tracks when an included spring is in its compressed state, thereby preventing rotation of the spool and locking the pay-out of the lanyard cable.

* * * * *